United States Patent [19]

Alverson

[11] Patent Number: 5,048,709

[45] Date of Patent: Sep. 17, 1991

[54] STRAW-CONTAINING COVER ATTACHMENT AND ASSEMBLY FOR A BEVERAGE CONTAINER

[76] Inventor: Robert M. Alverson, 1888 Shaw Mountain Rd., Boise, Id. 83712

[21] Appl. No.: 581,589

[22] Filed: Sep. 12, 1990

[51] Int. Cl.[5] ..... B65D 51/18

[52] U.S. Cl. ..... 220/90.2; 215/229; 215/1 A

[58] Field of Search ..... 220/90.2, 90.4, 90.6, 220/212, 233, 254, 256, 355, 375; 215/1 A, 229

[56] References Cited

U.S. PATENT DOCUMENTS

| | | | |
|---|---|---|---|
| 2,815,879 | 12/1957 | Hermes | 215/229 X |
| 3,332,567 | 7/1967 | Pugh, Sr. | 220/90.2 X |
| 3,349,987 | 10/1967 | Weitzner | 215/1 A X |
| 4,043,478 | 8/1977 | Duncan | 220/90.2 |
| 4,095,710 | 6/1978 | Tomiati | 220/90.2 |
| 4,573,631 | 3/1986 | Reeves | 220/90.2 X |
| 4,607,755 | 8/1986 | Andreozzi | 220/90.2 X |
| 4,735,329 | 4/1988 | Le | 215/229 |
| 4,775,060 | 10/1988 | Pinney | 215/1 A X |
| 4,850,495 | 7/1989 | Wallace | 215/1 A X |
| 4,930,652 | 6/1990 | Murphy et al. | 215/1 A X |

*Primary Examiner*—Stephen P. Garbe
*Assistant Examiner*—Vanessa M. Roberts
*Attorney, Agent, or Firm*—William J. Bethurum

[57] ABSTRACT

A straw-containing universal type cover assembly for a beverage container which includes a lid adapted to be snap fitted on an annular rim of the beverage container and is operative to simultaneously prevent spillage of and minimize decarbonation rates within the beverage once the container has been opened. The lid also includes a pull tab joined to the periphery thereof for both removing the lid from the beverage container and holding a straw in an upright position. The assembly further includes a multifunctional plug member attached to the straw by means of a flexible strap and having a stem portion operative to be inserted into an opening in the lid in one orientation, with the lid opening being generally aligned with a sealed or previously sealed opening in the top of the beverage container. The plug member further includes an integral straw cap portion operative to fit in another orientation of the plug member over one end of the straw when the beverage container has been opened and the straw is not being used.

3 Claims, 3 Drawing Sheets

STRAW-CONTAINING COVER ATTACHMENT AND ASSEMBLY FOR A BEVERAGE CONTAINER

TECHNICAL FIELD

This invention relates generally to protective and sanitary covers for beverage containers and more particularly to a universal type cover attachment for such containers and having a straw-containing assembly cooperatively arranged with such attachment in a novel manner.

BACKGROUND ART

Various designs have been proposed wherein a beverage container is provided with a drinking straw attached thereto and available to be inserted into the container at the time of use. Examples of such straw attachment designs for beverage containers are disclosed in U.S. Pat. No. 4,586,625 issued to Garrett in U.S. Pat. No. 4,582,213 issued to Park et al, in U.S. Pat. No. 3,792,798 issued to Chang, in U.S. Pat. No. 3,559,868 issued to Chang and in U.S. Pat. No. 3,445,033 issued to Sweet. These five (5) United States patents are merely representative of a larger number of patents which disclose beverage containers having straw attachment means therein; however, these five (5) U.S. patents appear to be not only good representative prior art with respect to the present invention, but prior art as relevant to be the present invention as any art of which the Applicant is currently aware. Therefore, these five United States patents are incorporated herein by reference.

Generally speaking, the above and other known prior art designs have not been such as to maximize cleanliness of the beverage container for the user thereof, both upon initially opening the container and upon a subsequent reuse thereof by children and adults alike who, for many and various reasons, do not wish to consume the entire beverage at one time. In addition, these prior art designs have not been particularly well suited to minimizing decarbonation rates within the beverage container and occurring between initial and secondary consumption of the beverage.

DISCLOSURE OF INVENTION

The general purpose and principal object of this present invention is to provide a new and improved straw-containing cover attachment and assembly which may be easily removable and then replaceable on the top of a standard beverage container, such as a cylindrical metal can.

Another object of this invention is to provide a new and improved assembly of the type described which is operative to maximize the cleanliness to the user during beverage consumption and to simultaneously prevent spillage of the beverage and minimize decarbonation rates within the beverage container once it has been opened and until the beverage has been completely consumed.

Another object of this invention is to provide a new and improved straw-containing cover attachment assembly of the type described which is of elegantly simple and straightforward construction and which may be easily manufactured to fit over most any type of beverage container.

Another object of this invention is to provide a new and improved straw-containing cover attachment and assembly for a beverage container of the type described which may be economically manufactured in large quantities and at high yields and then easily packaged for shipment to either beverage can manufacturers or to other consumers for the selective application to certain types of canned beverages.

A feature of this invention is the provision of a straw-containing cover attachment assembly of the type described which includes a novel pull tab arrangement which serves the dual function of enabling a lid attached thereto to be removed from the beverage container and also the function of holding and maintaining a straw in an upright position prior to use.

Another feature of this invention is the provision of a straw-containing cover attachment assembly of the type described which further includes a novel, multifunctional straw and lid plug member which, in one orientation, serves to plug an opening in the lid for the beverage container and thereby minimize decarbonation rates within the container, and in another orientation provides a cap for the straw when the container has been opened and the straw is not being used.

The above purpose, related objects, and novel features of this invention are provided by, among other things, a removable cover assembly for a beverage container of the type having an annular rim encircling a sealed or previously sealed opening on the top surface of the container. This removable cover assembly includes a removable lid having an annular receptacle located at its periphery and is of generally the same configuration as the annular rim of the beverage container and adapted to be removably snap-fitted on the beverage container rim. A pull tab is adjoined to the periphery of the removable lid and has an opening therein for receiving a straw, and the lid also has an opening therein which is generally aligned with the sealed or unsealed opening in the beverage container. A multifunctional plug member has a stem portion operative to be inserted into the opening in the lid in one orientation and has an integral straw cap portion which is integrally joined with the stem portion and is configured to fit over one end of the straw in another orientation of the plug member. The plug member is maintained in place within the assembly by means of a flexible strap which connects the plug member to the straw at all times, and the complete removable cover assembly described herein may be reused on a different beverage container, in which case the straw should be capped by the cap portion of the plug member during intervals between cover attachment assembly use.

The present invention summarized briefly above, along with its several objects and novel features, will become better understood with reference to the following description of the accompanying drawings.

DETAILED DESCRIPTION OF THE PREFERRED EMBODIMENT

Figure 1:
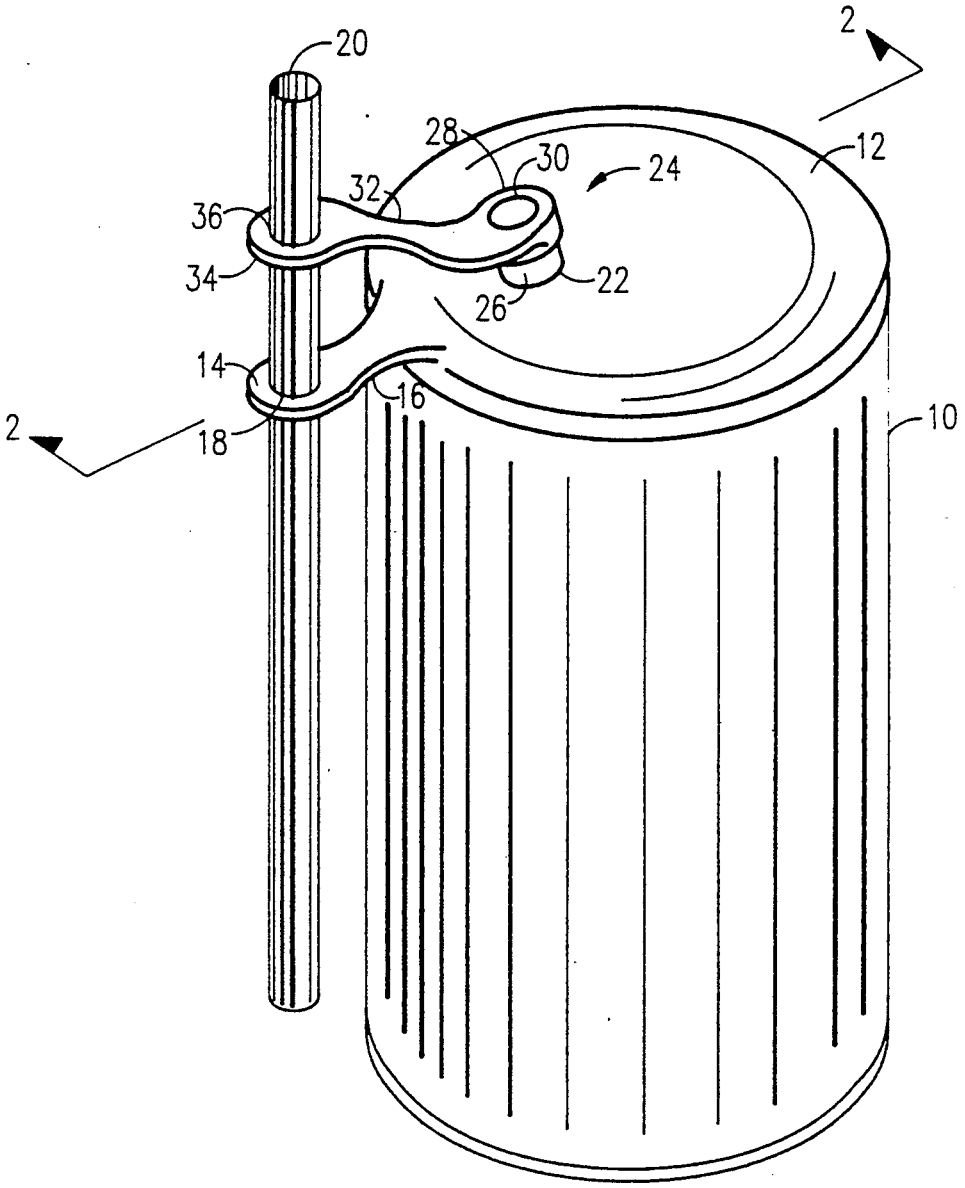
FIG. 1 is an isometric view showing the straw-containing cover attachment assembly snap fitted onto the top of a cylindrical beverage can.

Referring now to FIG. 1, there is shown a beverage container 10 which may, for example, be an aluminum can of conventional pop top or tab top upper construction having an annular upstanding rim thereon upon which the snap fit cover 12 is positioned as shown. The cover or lid 12 may be of either metal or plastic construction and includes an integral pull tab member 14 which is integrally joined to a region 16 at the outer periphery of the cover 12 as shown. The pull tab 14 further includes a cylindrical opening 18 therein through which a straw 20 is held in the upright position as shown.

The container cover 12 further includes an opening 22 therein through which a plug member 24 extends. The plug member 24 is designated generally as 24 and includes a lower stem portion or section 26 which extends through the cover opening 22, and the plug member 24 further includes an upper or cap portion or section 28. This upper section 28 has a receptacle or cavity 30 therein adapted for use in covering one end of the straw 20 as indicated and described further below.

The plug member 24 is integrally joined to a flexible strap member 32 which has an end section 34 with an opening 36 therein through which the straw 20 also extends and is there held and further secured in the upright position shown in FIG. 1.

Figure 2:
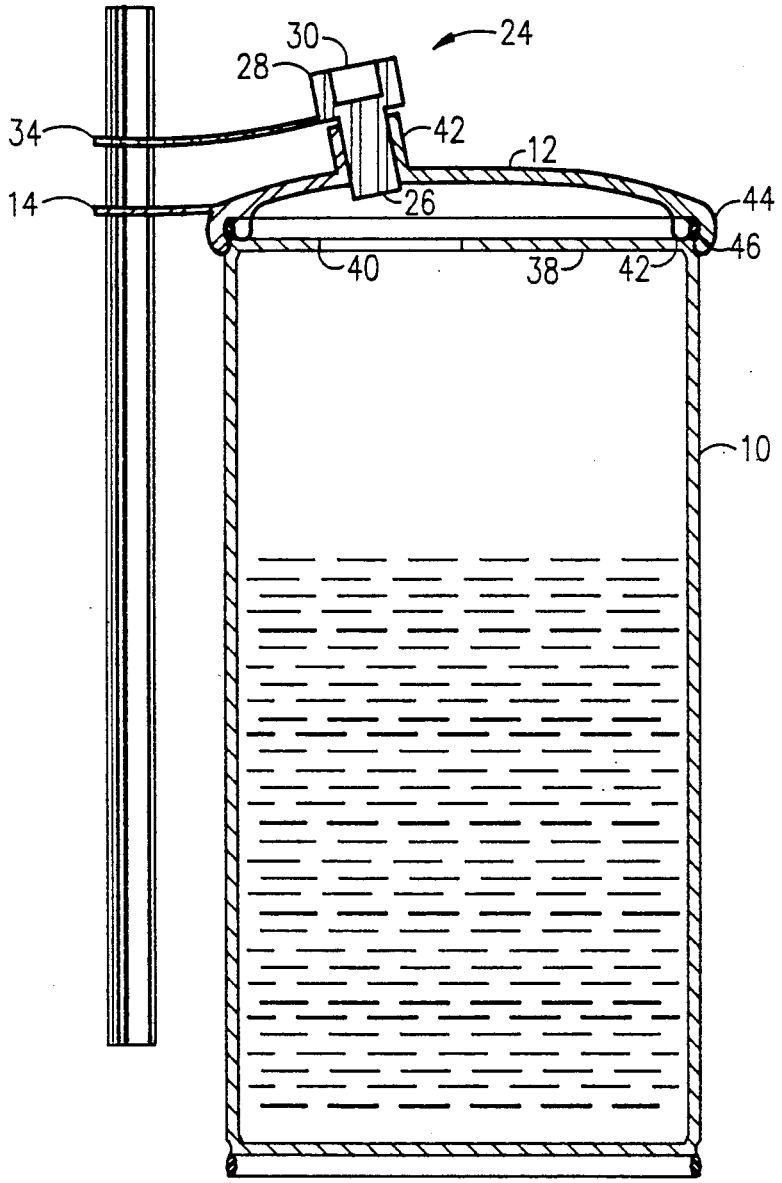
FIG. 2 is a cross section view taken along lines 2—2 of FIG. 1 and showing how the lid and associated plug member are aligned with the top of the beverage container and opening therein and snap-fitted onto the beverage container.

Referring now to FIG. 2, the beverage container or can 10 is shown in cross section with the pop top or cap removed from the upper or top section or wall 38 thereof so that an opening 40 in the top section 38 can be seen aligned generally with a vertical cylindrical upstanding port 42 which is an integral part of the cover 12. The stem portion 26 of the plug member 24 has been sized so as to fit snugly in the upstanding cylinder or port 42 of the cap 12. Thus, the cross sectional view shown in FIG. 2 represents the condition where the beverage can or container 10 has been previously opened, the cover or lid 12 snap fitted thereon by means of a pair of resilient peripheral lip sections 42 and 44 which are sized to fit tightly on the annular rim section 46 of the container 10 extending vertically from the side walls thereof. The cross sectional view in FIG. 2 may thus also represent a condition where the beverage in the container 10 has not been consumed at all, but rather the can 10 is either unopened or opened, and the plug member 24 has been inserted as shown into the opening 42 of the cover or lid member 12. However, the cross sectional view in FIG. 2 may also represent a condition where the beverage in the container 10 has been partially consumed and the straw 20 has been returned to its upright position as shown and held in place by the openings 18 and 36 in the pull tab member 14 and the flexible strap 34, respectively.

Figure 3:
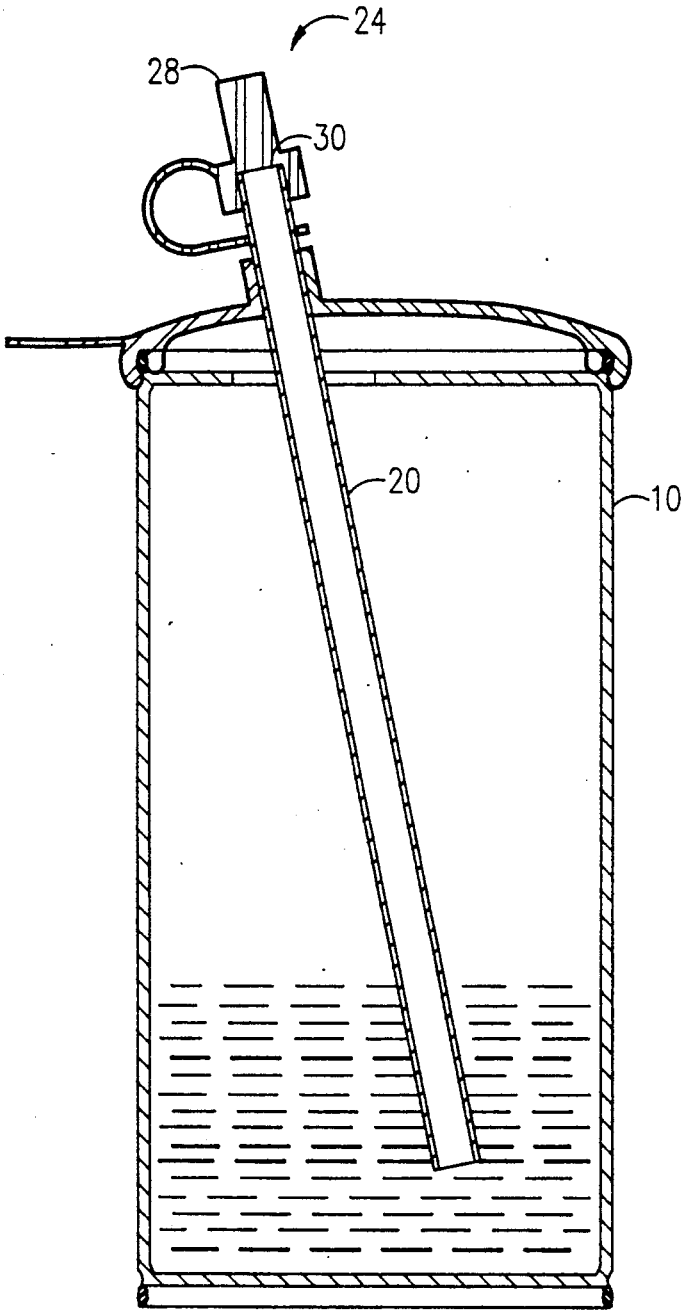
FIG. 3 is a cross section view corresponding to FIG. 2, but with the straw now inserted into the container and the cap end of the lid plug member covering the end of the straw when no beverage is being consumed.

Referring now to FIG. 3, the cross sectional view in this figure depicts a condition wherein the straw 20 has been used to consume some of the beverage in the container 10 and further wherein the plug member 24 is inverted in position relative to the positions shown in FIGS. 1 and 2 above so that the cap portion 28 of the plug member 24 is now used to cover the top end of the straw 20. Thus, not only is sanitation and cleanliness of the above described apparatus optimized and maximized as shown in FIG. 3, but in addition, the tight fit and tight sealing nature of this novel arrangement around the upper periphery of the container 10 is such that decarbonation rates within the beverage can or container 10 are minimized during the time interval between initial and secondary consumption of the beverage within the container.

Thus, there has been described a unique and novel straw-containing cover attachment and assembly for a beverage container which is completely different and unobvious with respect to any known prior art designs. This assembly enables the user to maximize cleanliness during extended beverage consumption and also to simultaneously prevent spillage of the beverage and minimize decarbonation rates within the beverage container once it has been opened. The above assembly is elegantly simple and straightforward in construction and may be easily manufactured to fit over most any type of beverage container having the upstanding annular rim portion thereon as indicated in FIGS. 2 and 3. Additionally, the cover attachment and assembly shown may be economically manufactured in large quantities and at high yields and then easily packaged for shipment to various types of consumers and beverage can manufacturers. As previously described, both the plug member 24 and the pull tab member 14 are multifunctional in nature and operation and thus provide an optimum number of separate functions for a corresponding minimum number of cover attachment parts necessary for packaging and shipment.

Various modifications may be made in and to the above described embodiment without departing from the spirit and scope of this invention. For example, various types of metal and insulation materials may be used for the various portions, sections and parts of the attachment and assembly described above without departing from the scope of the following appended claims.

I claim:

1. A removable cover assembly for a beverage container of the type having an annular rim encircling a sealed or previously sealed opening on a top surface of said container, including, in combination:

a. a removable lid having an annual receptacle at its outer periphery and of the same general configuration as said annular rim of said beverage container and adapted to be removably snap fitted on said rim, b. a pull tab adjoined to the periphery of said lid and having an opening therein for receiving a straw, c. said lid further having an opening therein generally aligned with said opening in said container, d. a multifunctional plug member having a stem portion operative to be inserted at one orientation into said opening in said lid and an integral straw cap portion operative in another orientation of said plug member to be fitted over one end of said straw, and e. a flexible strap connecting said multifunctional plug member to said straw.

2. A removable cover assembly for a beverage container of the type having an annular rim encircling a sealed or previously sealed opening on a top surface of said container, including, in combination:

a. a removable lid having an annular receptacle at its outer periphery and of the same general configuration as said annular rim of said beverage container and adapted to be removably snap fitted on said rim, b. a pull tab adjoined to the periphery of said lid and having an opening therein for receiving a straw, and c. said lid further having an opening therein generally aligned with said opening in said container.

3. A universal type removable cover assembly for a beverage container of the type having an annular rim encircling a sealed or previously sealed opening on a top surface of said container, including, in combination:

a. a removable lid having an annular receptacle at its outer periphery and of the same general configuration as said annular rim of said beverage container and adapted to be removably snap fitted on said rim, and b. a pull tab adjoined to the periphery of said lid and having an opening therein for receiving a straw, whereby said lid is operative to simultaneously prevent spillage of the beverage and minimize decarbonation rates therein once said container has been opened.

* * * * *